US006471742B2

(12) United States Patent
Dam

(10) Patent No.: US 6,471,742 B2
(45) Date of Patent: Oct. 29, 2002

(54) METHOD FOR PRODUCING AN IMPROVED CHARGING STOCK FOR USE IN METALLURGICAL PROCESSES

(76) Inventor: Oscar G. Dam, Urb. Los Saltos, Calle 4, Manzana 71 No. 22, Puerto Ordaz, Edo. Bolivar (VE)

( * ) Notice: Subject to any disclaimer, the term of this patent is extended or adjusted under 35 U.S.C. 154(b) by 0 days.

(21) Appl. No.: 09/767,008

(22) Filed: Jan. 22, 2001

(65) Prior Publication Data

US 2002/0096017 A1 Jul. 25, 2002

(51) Int. Cl.[7] ..... C21B 11/00

(52) U.S. Cl. ..... 75/572; 75/304; 75/751; 75/962; 164/459; 164/461

(58) Field of Search ..... 75/304, 314, 751, 75/962, 572; 164/459, 461

(56) References Cited

U.S. PATENT DOCUMENTS 3,862,657 A * 1/1975 Thalmann ..... 164/461
5,817,164 A * 10/1998 Dorofeev et al. ..... 75/316

FOREIGN PATENT DOCUMENTS

EP 0044183 * 1/1982 ..... 75/304

* cited by examiner

*Primary Examiner*—Melvyn Andrews
(74) *Attorney, Agent, or Firm*—Bachman & LaPointe, P.C.

(57) ABSTRACT

A method for producing an improved charging stock for use in further metallurgical processes including the steps of providing a source of molten metal of known composition, providing a source of solid particulate material of a known composition which is compatible with the molten metal, combining the molten metal source with the solid particulate material source to produce a combined stream and forming the combined stream into a plurality of uniformly sized metal billets for use in further metallurgical processes.

16 Claims, 2 Drawing Sheets

METHOD FOR PRODUCING AN IMPROVED CHARGING STOCK FOR USE IN METALLURGICAL PROCESSES

BACKGROUND OF THE INVENTION

The present invention relates to a method for producing an improved charging stock for use in metallurgical processes. This is achieved by combining a molten metal having a known composition with a solid particulate material, also having a known composition, in such a way so as to create a combined material stream.

Alloying charging stocks are used in the production of metal alloy compositions. As an example, in order to create an iron alloy composition have specific physical properties, a specific amount of an alloying charging stock would be added to molten iron. Because an alloy composition having specific physical properties is usually desired, it is beneficial to produce a alloying charging stock having a known size and composition.

Conventional methods of producing an alloying charging stock are well known in the prior art and achieve the charging stock production by mixing a molten metal with a particulate material within a mixing chamber. The mixed product is then cast into a large ingot. The ingot is then removed from the mold and crushed so as to create a plurality of larger coarse pieces of material, smaller fine pieces/chips of material and dust. The coarse pieces are separated from the dust and fine pieces/chips of material and are used for further metallurgical processes. One of the problems with current conventional methods is that the larger coarse pieces are of various sizes. Because the larger sized coarse pieces require more energy to melt than the smaller sized coarse pieces a waste of energy results. This is because when these coarse pieces are later added to a molten metal to produce a metal alloy, the temperature of the molten metal to which they are being added must be hot enough to melt the largest ingot. This results in lost energy due to an inefficient heating of the melt. The remaining dust and fine pieces/chips are collected and recycled by being added to the previously mentioned particulate material so as to be remixed with the molten metal. In addition, conventional methods create large amounts of dust and fine pieces/chips and only a limited portion of the resulting ingot can be used for further metallurgical processes while a significant amount of the resulting ingot must be recycled and remixed with the molten metal. Subsequently, because a significant portion of the resulting ingot must be separated and recycled, current conventional methods are inefficient, time consuming and expensive. Furthermore, conventional methods do not apply to any metals containing materials other than aluminum, iron oxide and ferrous alloys. Although improvements have been made in the prior art with respect to improving the charging stock, the main drawback of the casting process remains unchanged.

Subsequently, the need remains for a faster, less expensive and more efficient method of producing an improved charging stock for further use in the production and refining of primary metals, secondary metals and ferrous alloys than can be achieved by conventional methods.

It is therefore an objective of the present invention to provide a method for producing an improved, uniformly sized charging stock for use in further metallurgical processes while increasing process efficiency and reducing cost and time consumption.

SUMMARY OF THE INVENTION

In accordance with the present invention, the foregoing objects and advantages are readily attained.

A method is provided for producing an improved charging stock for use in further metallurgical processes which includes the steps of providing a source of molten metal of known composition, providing a source of solid particulate material of a known composition which is compatible with the molten metal, combining the molten metal source with the solid particulate material source so as to produce a combined stream and forming the combined stream into uniformly sized metal billets for use in further metallurgical processes.

Other objects and advantages will appear hereinbelow.

BRIEF DESCRIPTION OF THE DRAWINGS

A detailed description of preferred embodiments of the present invention follows, with reference to the attached drawings, wherein like numerals depict like elements.

DETAILED DESCRIPTION

In accordance with the present invention, a method is provided for producing an improved alloying charging stock for use in further metallurgical processes, such as for adding to a molten iron to create an alloy composition. This method provides for a greater degree of efficiency, a lower cost of production and a decrease in the time required to produce an alloying charging stock.

The method of the present invention combines a molten metal with a solid particulate material so as to create an alloying charging stock made of a combination of solid metal/metal oxide containing materials that may be non-rheologic in nature. Although the alloying charging stock may be combined by any conventional mixing method available in the art, it is preferably produced by combining a molten metal and a solid particulate material so as to create a flowable combined material stream having a desired composition. This combined material stream can then be discharged via a continuous cast into a movable mold and cut into uniformly sized metal billets having a desired shape. When the movable mold is cut into uniform sizes, material debris is left behind which can be recycled by adding it to the particulate material so as to be recombined with the molten metal. In accordance with the present invention, the solid particulate material may contain solid metal particles, a metal alloy or a combination of solid metal particles and metal alloy as long as the mixture contains a metal/metal oxide containing material. These solid metal particles may be in the form of chips, turnings, borings, powder, fines, fragmented scrap and the like. Also, the metal/metal oxide containing materials may be drosses, pre-reduced materials, mill scale, oxides or the like.

Also, the temperature of this combined material stream may be brought close to the solidus/liquidus temperature of the corresponding molten material if needed to obtain a desired physical mix and associated chemical reaction in order to achieve a desired viscosity and plasticity.

In accordance with the present invention, the viscosity of this combined material stream is controlled by the solid particle to molten metal ratio and/or by introducing an external cooling apparatus so as to control the temperature of the material stream. By controlling the viscosity of the combined material stream, the mixture will be able to flow in a continuous cast into a movable mold. In accordance with the present invention, the movable molds may be horizontal, rotating or the like.

In addition, it should be noted that the viscosity of the combined material should be matched to the pulling action of the shaping member so as to create a continuous process flow.

Figure 1:
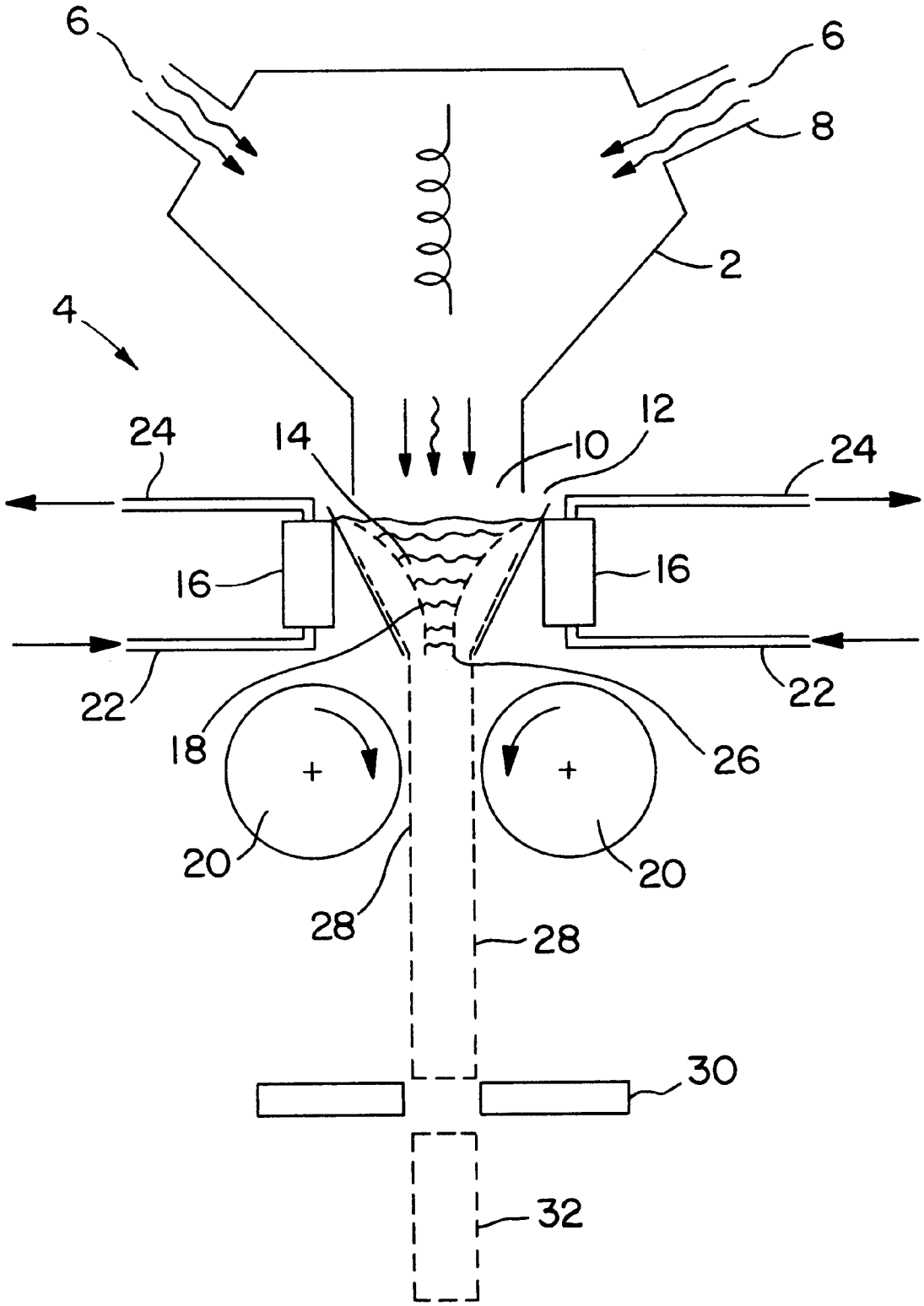
FIG. 1 illustrates a preferred embodiment of the present invention showing a method of producing an improved charging stock via a continuous cast into a movable mold.

Referring to the drawings, a preferred embodiment will be discussed. As shown in FIG. 1, a particulate collection zone 2 is provided having a first inlet 8 for receiving a solid particulate material 6 and a first outlet 10 for discharging the solid particulate material 6. In addition, a casting zone 4 is provided having a second inlet 12 for receiving a molten metal 14, an external cooling apparatus 16, disposed so as to cool the molten metal 14 so as to cause molten metal 14 to form a crust like shell 18, a shaping member 20 for shaping the combination of the particulate material 6 and molten metal 14 into a combined stream 28 and a second outlet 26 for discharging the combined stream 28 from casting zone 4. casting zone 4 is disposed so as to communicate first outlet 10 with second inlet 12. Lastly, a cutting member 30 is provided and disposed so as to interact with and cut the combined stream 28 into uniformly sized metal billets 32.

Referring to FIG. 1 the method of the present invention is illustrated and shows a particulate material 6 being introduced into particulate collection zone 2 via first inlet 8. A molten metal 14 is shown within casting zone 4 and is introduced into casting zone 4 via second inlet 12 so as to be cooled by external cooling apparatus 16 having a coolant inlet 22 and a coolant outlet 24. In order to cool molten metal 14 so as to form a crust like shell 18, a coolant is cycled into coolant inlet 22 and out of coolant outlet 24. The cooling apparatus 16 decreases the temperature of the molten metal 14 so as to cause the molten metal 14 to form a crust like outer shell 18. Particulate material 6 is then allowed to flow through first outlet 10 into second inlet 12 and into the crust like outer shell 18 so as to become combined with molten metal 14. Shaping member 20 pulls the combination of particulate material 6 and molten metal 14 via outer shell 20 through second outlet 26 so as to form a combined stream 28 having a crust like outer shell 18. The combined stream 28 exits the casting zone 4 as a continuous cast and interacts with a cutting member 30, wherein the cutting member cuts the combined stream 28 into uniformly sized metal billets 32. The uniformly sized metal billets are then cooled via ambient temperature, a quenching pond, a cooling chamber or the like. During the cutting process material chip, fines and dust are created and collected and recycled back into the particulate material 6. In accordance with the present invention, particulate material 6 may be preheated prior to entering outer shell 20 through second outlet 26. Particulate material 6 may be preheated using any suitable known means available in the art.

Figure 2:
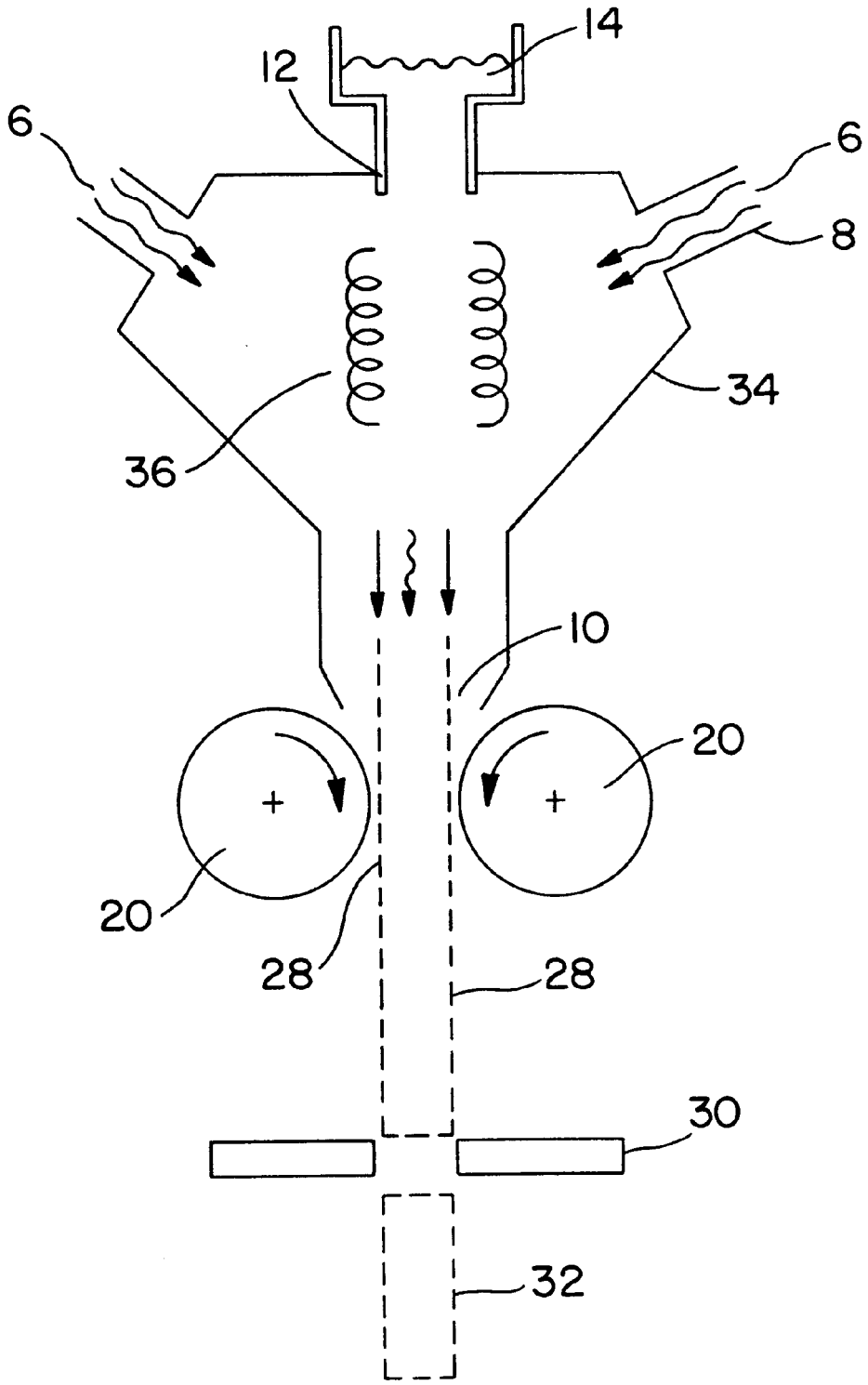
FIG. 2 illustrates a second embodiment of the present invention showing a method of producing an improved charging stock via a continuous cast into a movable mold.

An additional embodiment is as shown in FIG. 2. A mixing zone 34 is provided having a mixing member 36, a first inlet 8 for receiving a solid particulate material 6, a second inlet 12 for receiving a molten metal 14, an outlet 10 for discharging a mixture of particulate material 6 and molten metal 14 and a shaping member 20 for shaping the combination of the particulate material 6 and molten metal 14 into a combined stream 28. Shaping member 20 is disposed so as to receive the combination of the particulate material 6 and molten metal 14 from the outlet 10. Lastly, a cutting member 30 is provided and disposed so as to interact with and cut the combined stream 28 into uniformly sized metal billets 32.

Referring to FIG. 2 a second embodiment is discussed. A solid particulate material 6 is introduced into mixing zone 34 via first inlet 8. A molten metal 14 is also introduced into mixing zone 34 via second inlet 12, wherein molten metal 14 and particulate material 6 are mixed via mixing member 36 so as to create a substantially homogeneous composition. The mixture of molten metal 14 and particulate material 6 is allowed to flow through outlet 10 so as to interact with shaping member 20. Shaping member 20 acts on this mixture of molten metal 14 and particulate material 6 so as to form a combined stream 28. The combined stream 28 then interacts with cutting member 30 so as to be cut into a plurality of uniformly sized billets having a substantially homogeneous composition. The billets are then cooled via any suitable cooling means. Cutting these billets create some material debris in the form of chips, fines and dust. This debris is then collected and recycled back into the particulate material. In accordance with the present invention, particulate material 6 may be preheated prior to being mixed with molten metal 14. Particulate material 6 may be preheated using any suitable known means available in the art In accordance with the present invention, the movable mold may be horizontal, rotating or the like.

In accordance with the present invention, the solid particulate material 6 may be heated so as to achieve a temperature that is close to the solidus/liquidus temperature of the corresponding combination stream. In addition, the ratio of the molten metal 14 to the solid particulate 6 may be predetermined so as to achieve a desired product flow rate needed to create a continuous process flow. The flow rate should be determined so as to match the pulling action of the movable molds.

In accordance with the present invention, the coolant may be any suitable coolant known in the art, such as air, water or the like.

It is also to be understood that this invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

I claim:

1. A method for producing an improved charging stock for use in further metallurgical processes comprising the steps of: providing a source of molten metal of known composition; providing a source of solid particulate material of a known composition which is compatible with said molten metal; combining said molten metal source with said solid particulate material source to produce a combined material stream; shaping said combined material stream with a moving shaping means for forming a continuous cast; and separating said continuous cast into a plurality of uniformly sized metal billets for use in further metallurgical processes.

2. A method according to claim 1, further comprising providing a particulate collection zone and a casting zone, said particulate collection zone having a first inlet for receiving said particulate material source and a first outlet for discharging said particulate material and said casting zone having a second inlet for receiving said molten metal source, a means for cooling said combined material stream, a second outlet for discharging said combined material stream to said shaping means for shaping said combined material stream.

3. A method according to claim 2, further comprising providing said particulate collection zone disposed relative to said casting zone so as to communicate said first outlet with said second inlet.

4. A method according to claim 2, further comprising providing a casting zone wherein said shaping means is disposed so as to allow interaction between said shaping means and said combined material stream.

5. A method according to claim 1, further comprising the step of collecting and recycling chips, fines, and dust created from forming said billets, by reintroducing said chips, fines and dust into said particulate material source.

6. A method according to claim 5, further comprising said continuous cast through said outlet with said shaping means.

7. A method according to claim 1, further comprising cooling and cutting said continuous cast into uniformly sized metal billets.

8. A method according to claim 2, further comprising introducing said molten metal source into said casting zone so as to be communicated with said cooling means, wherein said molten metal source is cooled so as to form an outer shell.

9. A method according to claim 8, further comprising introducing said particulate material source so as to cause said particulate material source to be combined with said molten metal source within said outer shell.

10. A method according to claim 1, further comprising heating said particulate material so as to be substantially equal to the solidus/liquidus temperature of said combined material stream.

11. A method according to claim 1, further comprising providing a mixing zone having a first inlet for receiving a particulate material, a second inlet for receiving a molten metal source, a mixing means for mixing said particulate material source with said molten metal source so as to create said combined material stream and an outlet for discharging said combined material stream.

12. A method according to claim 11, further comprising introducing said molten metal source and said particulate material source into said mixing zone and operating said mixing means to mix said molten metal source and said particulate material source so as to create said combined material stream having a substantially homogeneous composition.

13. A method according to claim 1, further comprising the step of introducing said plurality of uniformly size metal billets to molten iron so as to create an alloy composition.

14. A method according to claim 1, further comprising providing a cutting means for cutting said combined material stream into uniformly sized metal billets.

15. A method according to claim 1, further comprising providing said shaping means as a moving mold.

16. A method according to claim 1, further comprising the step of determining the desired ratio of said particulate material to said molten material so as to achieve a material composition having a desired viscosity and plasticity.

* * * * *